US005996813A

United States Patent [19]

Hendrix et al.

[11] Patent Number: 5,996,813

[45] Date of Patent: Dec. 7, 1999

[54] ASSEMBLY STAND FOR WEDDING BOUQUETS AND PEW HOLDERS

[75] Inventors: Mary Ann Hendrix, 1346 Bennett Rd.; M. Venita Barnes, 1608 San Jose La., both of Paradise, Calif. 95969

[73] Assignees: Mary Ann Hendrix; M. Venita Barnes, both of Paradise, Calif.

[21] Appl. No.: 09/016,968

[22] Filed: Feb. 2, 1998

[51] Int. Cl.[6] ..... A47F 7/00

[52] U.S. Cl. ..... 211/13.1; 47/41.01; 47/41.12

[58] Field of Search ..... 47/41.01, 41.12; 182/186.3; 211/13.1; 248/27.8; 256/64; 269/76

[56] References Cited

U.S. PATENT DOCUMENTS

| | | | |
|---|---|---|---|
| 2,197,187 | 10/1940 | Larson | 182/186.3 |
| 2,249,685 | 7/1941 | Dearing | 256/64 |
| 2,843,972 | 6/1958 | Cowart | 47/41.01 |
| 2,907,238 | 7/1959 | White | 269/76 |
| 4,964,237 | 10/1990 | Specht | 47/41.01 |
| 5,787,638 | 8/1998 | Harshman | 47/41.12 |

*Primary Examiner*—Michael J. Carone
*Assistant Examiner*—Francis T. Palo, Jr.

[57] ABSTRACT

A flower arrangement stand with multiple work station blocks for maintaining pew and bouquet holders stable while making up flower arrangements using the holders.

4 Claims, 2 Drawing Sheets

ASSEMBLY STAND FOR WEDDING BOUQUETS AND PEW HOLDERS

BACKGROUND OF THE INVENTION

This invention relates to assembly stands for flower arrangement. The present invention is particularly directed towards an assembly stand for flower arrangement having multiple stations for maintaining pew holders and bouquet holders stable while making up flower arrangements using the holders.

Most florists who make up bouquets and floral arrangements for weddings, funerals, and other occasions use available types of holders. The holders are usually an open plastic or wire frame encasing a plastic core which accepts insertion of flower stems and ends of other bouquet materials. These arrangement holders are usually provided in two types. A first type is a bouquet holder which is usually cylindrical, has a solid cone-shaped back side the upper perimeter of which is edged with open squares, and a short handle-like arm is affixed centrally to the apex of the cone. A second type has a cylinder shaped cage-like front and a solid cap-like back. Attached to the back is a flat plastic strip which extends somewhat above the cage frame, loops over and runs back down forming an opened end that aligns with the end fastened to the back of the cage. This arrangement is called a "pew bow" and is designed to be hung over the back of a church pew—or to any available support. Some of the pew holders have box shaped flower mounting frames. Unfortunately, both of these commercially available holders have to be hung onto something or the arm poked into a hole for stabilizing them while a flower arrangement is being made up. A practical work stand with several holding stations that would accept both types of support arms, straight and curved, has not been available until the development of the present invention.

BRIEF SUMMARY OF THE INVENTION

Therefore, in practicing our invention, we provide a practical stand that will accept the arms of these holders both curved and straight and maintain the holders secured while floral arrangements are being made up on them. The stand of our invention has multiple work stations along either side of a central rail and removable stabilizing legs that position the holders at a useful working level. The work stations consist of small block-like units having spacers on the back which allow the straight arms of the bouquet holders to slide easily in between them and the center rail. The opening is also designed to accept the straight free end of the looped arm of the pew holder. Both types of holder arms fit the opening easily, are well maintained by the opening size for flower arrangement work, and the holders can be easily removed from the stations when the work is completed. Two vertical strips on the fronts of each station block provide a back rest for the pew holders as well as a grove for the back-attached flat side of the curved holder arm to fit into. Although a wooden stand as described herein fits well with the decor of most flower shops, our stand lends itself well for manufacture of wood, metal, or plastic.

As principal object, our invention provides a stabilizing flower arrangement stand for pew holders and bouquet holders.

Another object of the invention is to provide a stand with multiple flower arrangement work stations along either side of a central rail that allows several bouquets to be made up or displayed at the same time.

A further object of our invention is to provide a stand with work stations that will accept both curved pew holder support arms and straight bouquet holder arms and will position the holders stable at a comfortable working height.

A still further object of the present invention is to provide a multiple work station for floral arrangements that can be disassembled when not in use for transportation or storage.

Other objects and the many advantages of the present invention will be better understood by reading descriptions of numbered parts in the specification and comparing them with like numbered parts illustrated in the included drawings.

DETAILED DESCRIPTION OF THE INVENTION

Figure 1:
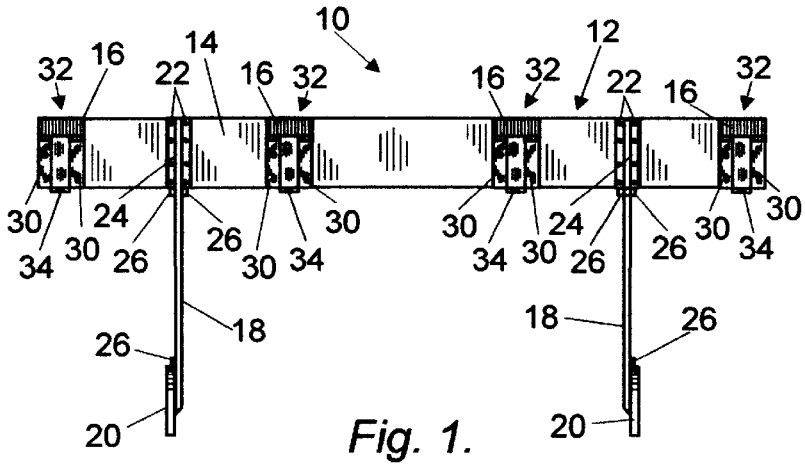
FIG. 1 shows a side elevation view of a multiple work station stand for maintaining bouquet and pew holders stable during flower arrangement in accordance with the present invention.
Figure 2:
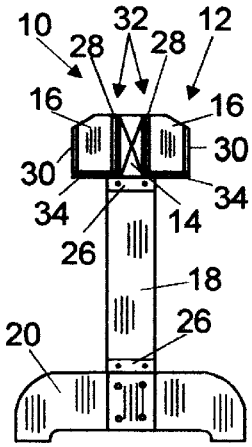
FIG. 2 shows the present invention in an end view.
Figure 3:
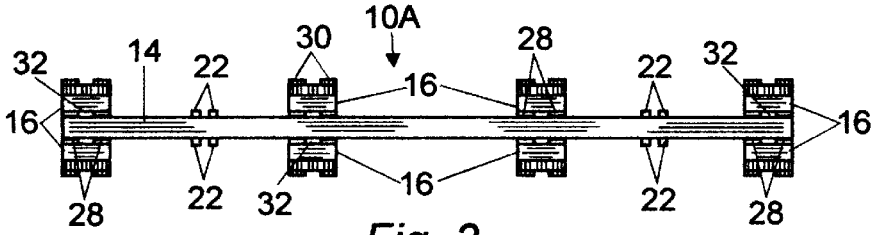
FIG. 3 shows the center rail of the present invention only with the multiple work stations, called work station blocks, along either side and the leg support guides into which the leg attachment ends fit when the legs are installed.
Figure 7:
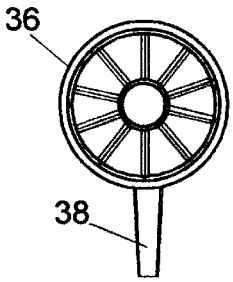
FIG. 7 shows a typical round frame type bouquet flower arrangement holder.
Figure 8:
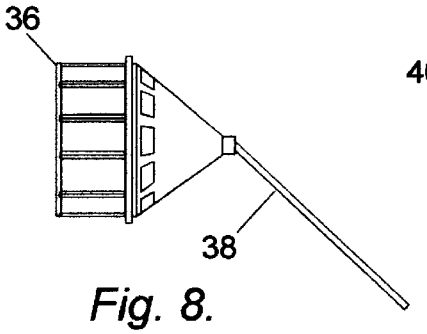
FIG. 8 shows the bouquet holder of FIG. 7 in a side view.
Figure 9:
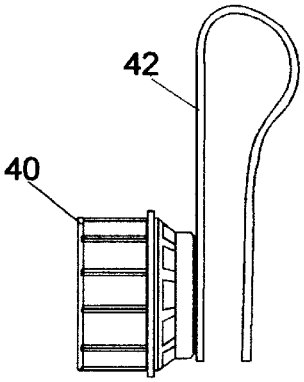
FIG. 9 shows a typical pew flower arrangement holder with a curved support arm, the arm being for hanging the holder from the back of a church pew.

Turning now to the drawings where the assembled invention is indicated as assembled stand 12 and referenced generally as invention 10 and invention parts are referenced as parts 10A, referring to FIG. 1. In FIG. 1, invention 10 is shown as assembled stand 12 having an elongated center rail 14. Center rail 14 has two wide side surfaces and two narrow edges and 14 is held horizontally by vertical legs 18 with the two narrow edges of rail 14 upwardly and downwardly. For stabilization, each vertical legs 18 has a widened foot 20 horizontally attached at the lower end. In FIG. 1, work station blocks 16 are spaced along the wide sides of rail 14 and actually run along both side of rail 14 as can be seen in FIG. 3. In FIG. 2, assembled stand 12 is shown in an end view. Addition parts of stand 12 shown in FIGS. 1 and 2 include leg support guides 22, leg attachment ends 24 that fit up between guides 22, and support blocks 26 that strengthen legs 18 where rail 14 sets at the top and where feet 20 attach at the bottom of legs 18. Work station blocks 16 have vertical spacers 28 at the back between them and rail 14. Spacers 28 are separated centrally leaving a small rectangular opening 32 between rail 14 and block 16. Opening 32 is the receiver opening which accepts the arm 38 of bouquet holder 36 and of looped arm 42 of pew holder 40. See FIGS. 7, 8, and 9 for illustrations of these holders and FIGS. 11 and 12 to see how they are installed and held in work station blocks 16. In addition, blocks 16 each have two frontal strips 30 attached vertically on the small front surfaces. Blocks 16 have a downward angled front top section that produces the smaller front surface. Frontal strips 30 are separated sufficiently to provide a center opening for the back side attachment of looped arm 42 of pew holder 40 when a pew holder 40 is held in a station block 16 with its back side resting on vertical strips 30. The front angled top of blocks 16 is especially designed for accepting the back side of pew holder 40. See FIG. 12.

In FIG. 3, center rail 14 is shown in a top plan view without legs 18 attached. Work station blocks 16 can be seen spaced oppositely along both sides of center rail 14. Leg support guides 22 are positioned outwardly between work block stations 16 towards either end of center rail 14. Frontal strips 30 are on the front surface of blocks 16 and spacers 28 are at the back where blocks 16 attach to rail 14. Holder arm receiver openings 32 are formed by the separation of spacers 28. So that the arms of holders 36 and 40 can not drop all the way through receiver openings 32, stop strips 34 are fastened to the bottoms of blocks 16 to just cover the opening 32 at the back and the opening between frontal strips 30 at the front of work station blocks 16. Stop strips 34 can be seen in FIGS. 1 and 2.

Figure 4:
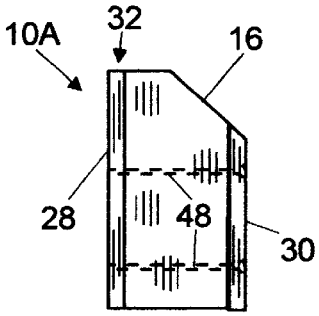
FIG. 4 shows a work station block in a side view.
Figure 5:
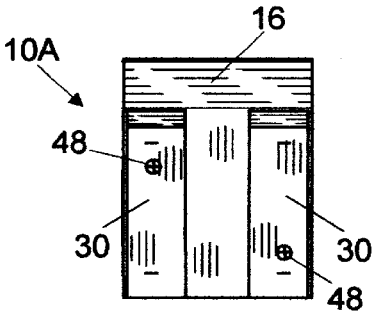
FIG. 5 shows the work station block in a frontal view.
Figure 6:
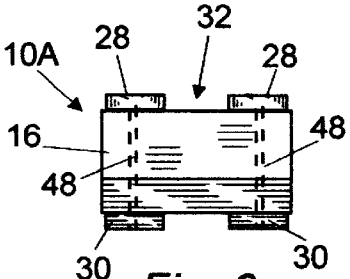
FIG. 6 shows the work station block in a top plan view.

In FIGS. 4, 5, and 6, a work station block 16 is shown in a side view, a front view, and a top plan view respectively. Elongated screws 48 that hold frontal strips 30 and spacers 28 and block 16 to rail 14 are indicated.

Figure 10:
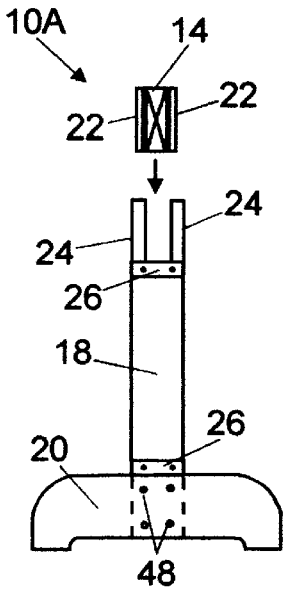
FIG. 10 in a line drawing, shows a leg assembly of the present invention positioned to receive the center rail which is illustrated above the leg attachment ends.

In FIG. 10, center rail 14 is shown above leg 18 ready to be lowered onto leg 18 with leg attachment ends fitting into leg support guides 22. This arrangements allows invention 10 to be assembled and disassembled easily.

Figure 11:
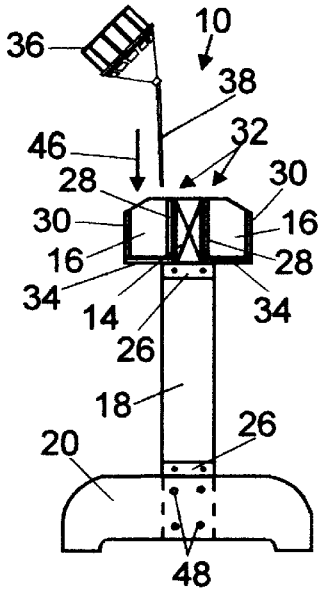
FIG. 11 shows the assembled stand in a line drawing from an end view having a bouquet holder. positioned above the station block with the arm ready for insertion into the opening between the center rail and the station block.
Figure 12:
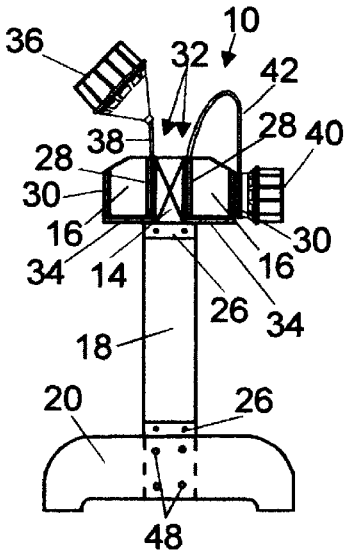
FIG. 12 in a line drawing, shows the invention from an end view with both the bouquet holder and the pew holder affixed in the slots of the work station blocks, one on each side of the center rail.

FIG. 11 shows how bouquet holder 36 is installed in work station block 16. Arm 38 can be dropped into either receiver opening 32 with stop strip 34 preventing the arm from dropping all the way through opening 32. In FIG. 12, both bouquet holder 36 and pew holder 40 are shown positioned in work stations 16 back to back ready for flower arrangement work using either holder.

Figure 13:
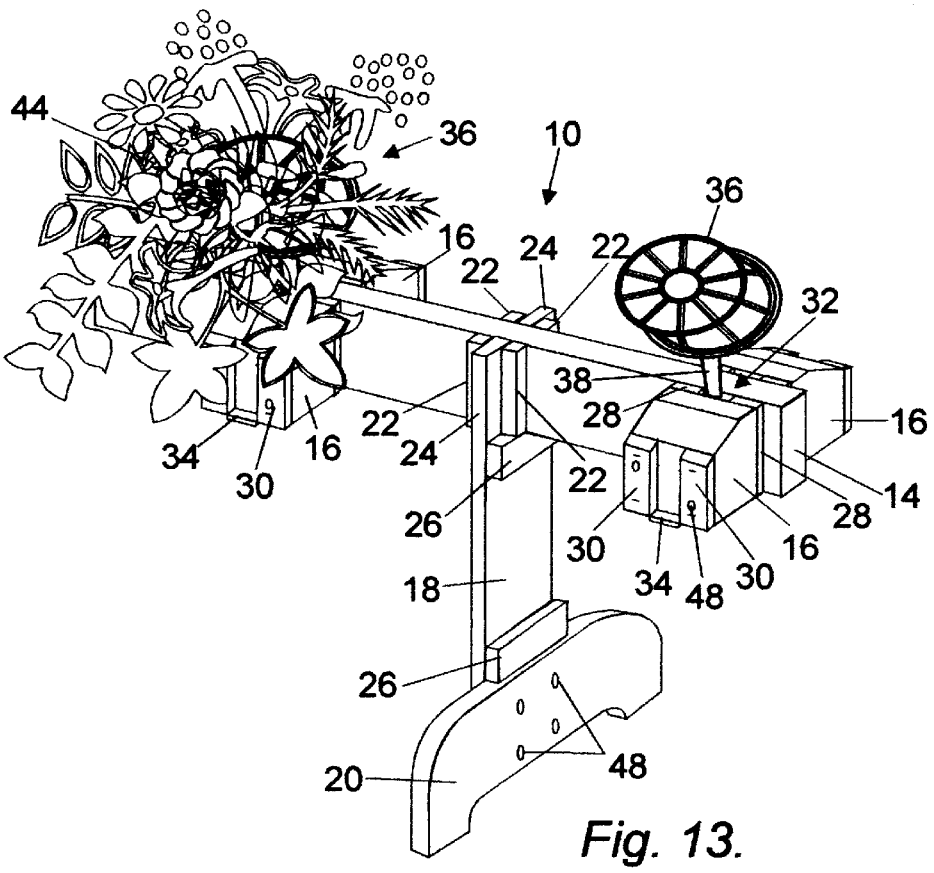
FIG. 13 show s a partial perspective e nd view section of the assembled stand illustrating the stand in use with a floral arrangement being assembled in one of the multiple block work stations.

FIG. 13 shows invention 10 in a sectional perspective illustration. A first work station block 16 is holding a holder 36 and is being used to assemble a floral arrangement. A second work station block 16 has a bouquet holder 36 positioned for use with its arm 38 in receiver opening 32. Legs 18 position the holders 36 at an easy work height. It is to be noted that the bouquet holder 36 and the pew holder 40 are commercially available and are for illustration only in this specification.

Although we have described an embodiment according to the invention with considerable details in the foregoing specification and illustrated it extensively in the drawings, it is to be understood that we may make changes in the structure of the device so long as any changes made remain within the scope of the appended claims and any changed devices similar to ours made by others that fall within our claim scope, we shall consider such devices to be our invention.

What is claimed is:

1. A stand for maintaining pew and bouquet type flower arrangement holders temporarily positioned during floral assembly, comprising:

a. an elongated center rail having two wide sides and two narrow edges;

b. a multiple of work station blocks attached and aligned oppositely along said wide sides of said center rail;

c. at least two vertical legs removably attached to said center rail holding said rail in a substantially horizontal position with one of said narrow edges positioned upwardly and one of said narrow edges positioned downwardly;

d. vertical spacers attached to said work station blocks between said rail and said work station blocks in a manner to provide a center vertical opening between them;

e. at least two vertical strips attached to said work station blocks in a frontal position in a manner to provide a vertical opening between them;

f. attachment means for affixing said work station blocks removably to said central rail;

g. stopping means preventing free passage through lower openings between said spacers and said vertical strips attached to said work station blocks.

2. The stand of claim 1 wherein said opening between said spacers where said blocks attach to said rail provides a receiver opening for holder arms of said pew and said bouquet type holders.

3. The stand of claim 1 wherein said two vertical frontal strips attached to said work station provide back resting and limited passageway for an attached arm and back side of said pew holder.

4. The stand of claim 1 wherein said stopping means preventing free passage through lower openings between said spacers and said vertical frontal strips is a stop strip fastened to the bottom of said work station blocks.

* * * * *